United States Patent [19]

Pringle

[11] 4,095,298

[45] Jun. 20, 1978

[54] BED ASSEMBLY

[75] Inventor: William L. Pringle, Grosse Pointe Shores, Mich.

[73] Assignee: United States Steel Corporation, Pittsburgh, Pa.

[21] Appl. No.: 765,990

[22] Filed: Feb. 7, 1977

Related U.S. Application Data

[63] Continuation-in-part of Ser. No. 610,699, Sep. 5, 1975, Pat. No. 4,020,512.

[51] Int. Cl.[2] ..... A47C 23/04

[52] U.S. Cl. ..... 5/263; 5/265; 5/310

[58] Field of Search ..... 5/260–264 R, 5/265, 279 R, 279 B, 282 R, 310; 108/51.1

[56] References Cited

U.S. PATENT DOCUMENTS

| | | | |
|---|---|---|---|
| 795,373 | 7/1905 | Staples | 5/279 B |
| 2,599,723 | 6/1952 | Row | 5/282 R |
| 2,841,209 | 7/1958 | Wetzler | 5/263 |
| 2,843,857 | 7/1958 | Wetzler | 5/264 |

*Primary Examiner*—Casmir A. Nunberg
*Attorney, Agent, or Firm*—McGlynn and Milton

[57] ABSTRACT

A bed assembly comprising a metal frame of generally rectangular configuration including a pair of opposed side rails and a pair of opposed end rails and a plurality of metal slats extending transversely between the side rails in spaced parallel relationship to one another and to the end rails. Both of the end and side rails have a hollow cross section along their respective lengths. The hollow cross section in each of the rails is defined at least by two metal members welded together. The end rails of a first embodiment and all of the rails of a second embodiment are defined by a pair of U-shaped members having their legs overlapping with the bases of the U shapes spaced from one another to define the hollow cross section. The side rails of the first embodiment are defined by channeled members having a channel extending therealong and a plate-like strip covering the channel to define the hollow cross section. Each of the slats has a cross section including a base, downwardly extending diverging legs and a flange extending laterally outwardly from the lower end of each leg. Spring retaining apertures are disposed in the bases of the slats and the end rails for engaging and gripping a spring inserted into the aperture. Three tabs extend into each aperture and each aperture is disposed in a concavity for guiding the spring into each aperture.

21 Claims, 11 Drawing Figures

BED ASSEMBLY

This application is a continuation-in-part of copending application Ser. No. 610,699, filed Sept. 5, 1975 now U.S. Pat. No. 4,020,512.

The subject invention relates to a bed assembly and, more particularly, to a box spring assembly of the type for supporting a mattress.

Prior art box spring assemblies have been fabricated from wood and metal, however, the problem with most of the prior art assemblies is that there is not an assembly available which may be economically and easily manufactured yet provides the requisite strength characteristics. Many of the prior art assemblies may allow a high degree of "rack" where one corner may be lifted an unreasonable amount while the remaining three corners remain resting upon a support. Such assemblies typically require support frames when in use.

A bed assembly of the subject invention may be very economical and easily manufactured, yet provides substantial strength when assembled. Such may be accomplished by a bed assembly constructed in accordance with the instant invention having a metal frame of a generally rectangular configuration including a pair of opposed side rails and a pair of opposed end rails with each of the rails having a hollow cross section along their respective lengths. Two embodiments of the bed assembly are disclosed and each include the specific rail comprising first and second members each with a U-shaped cross section with the second member having shorter legs than the first member. The legs are secured together with the base portions of the U shapes spaced apart to define the hollow sections. In the first embodiment of this rail, the members are separate and the legs are all welded together whereas in the second embodiment of the rail the members are integrally formed so that mating legs are integral with one another. The assembly may also include a hollow rail comprising a channeled member with a cover over the channel thereof.

Other advantages of the present invention will be readily appreciated as the same becomes better understood by reference to the following detailed description when considered in connection with the accompanying drawings wherein.

Figure 1:
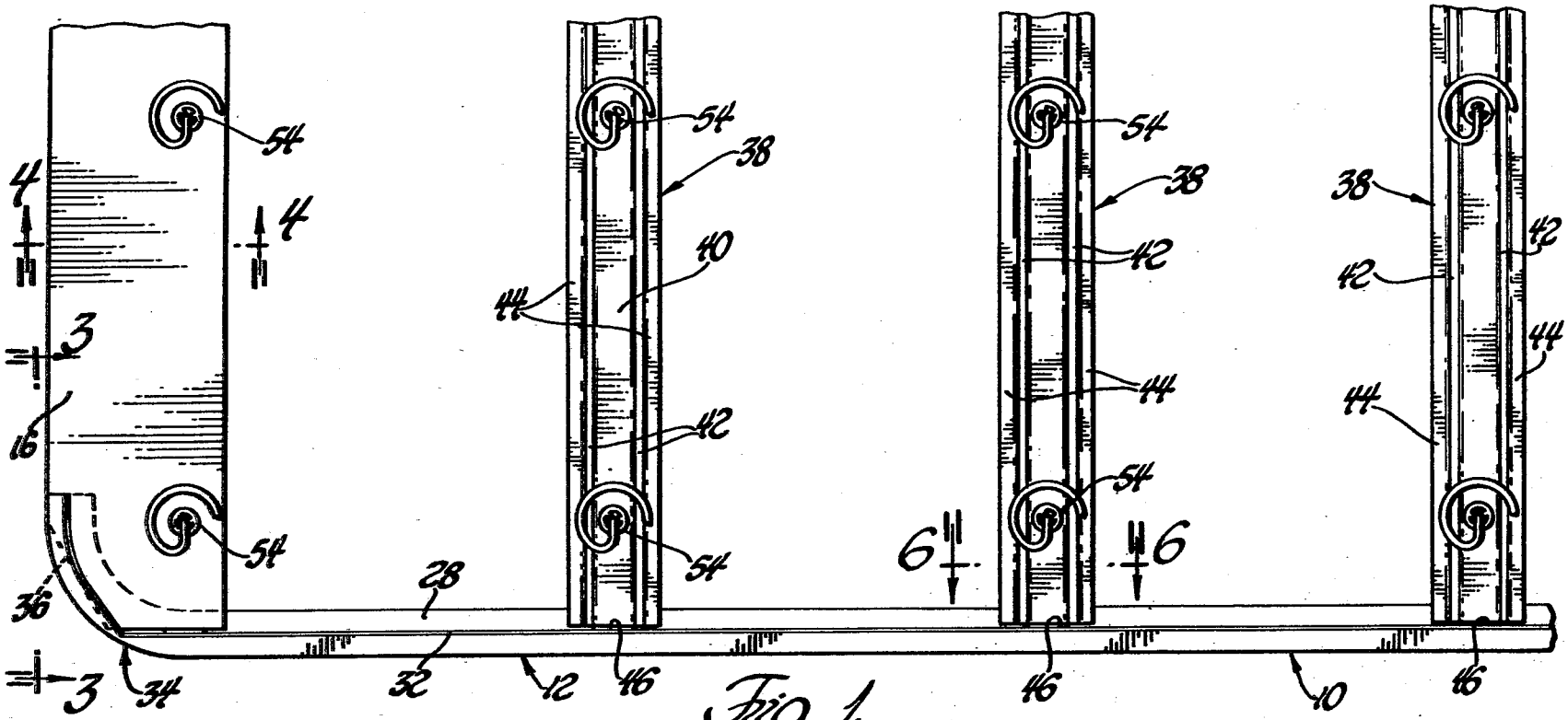
FIG. 1 is a fragmentary plan view showing one corner of a first embodiment of a bed assembly constructed in accordance with the subject invention.
Figure 2:
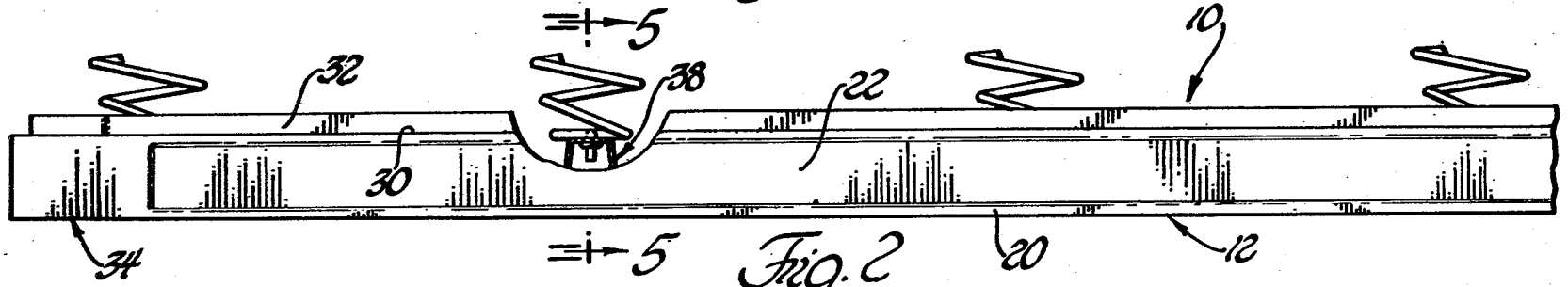
FIG. 2 is a fragmentary side view partially broken away and in cross section of the assembly shown in FIG. 1.
Figure 3:
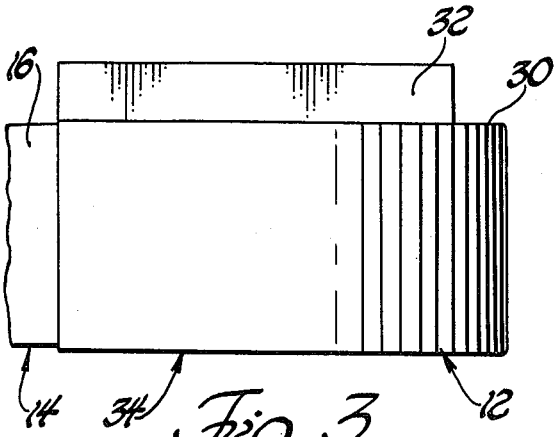
FIG. 3 is an enlarged view taken substantially along line 3—3 of FIG. 1.

The first embodiment of the bed assembly of the instant invention includes a metal frame means generally shown at 10 in FIGS. 1 and 2. The metal frame means is of a generally rectangular configuration, although only approximately one-quarter of the assembly is shown in FIG. 1. The metal frame means 10 includes a pair of opposed side rails, one of which is generally indicated at 12. Also included are a pair of opposed end rails, one of which is generally indicated at 14. Each of the rails 12 and 14 have a hollow cross section along their respective lengths thereof. The hollow cross section of the rails 12 and 14 add substantial strength to the rails so that the rails cannot individually be twisted thereby preventing racking of the entire frame assembly where one corner can be elevated higher than the remaining corners. Such strength eliminates the need for supporting frame and legs may be attached directly to the frame.

Figure 4:
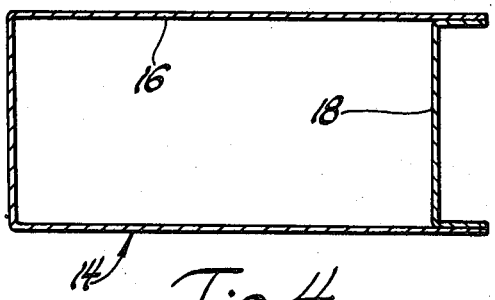
FIG. 4 is an enlarged cross-sectional view taken substantially along line 4—4 of FIG. 1.

More specifically, each of the end rails includes first and second metal members 16 and 18, as shown in FIG. 4, defining the hollow cross section. The first member 16 is U-shaped in cross section as is the second metal member 18. The second metal member 18 has shorter legs than the first U-shaped member 16 and the legs of the respective members 16 and 18 are secured together by welding so that the base portions of the U-shaped members are horizontally and/or laterally spaced apart to define the hollow cross section. The short legs of the second member 18 are disposed within the legs of the larger U-shaped member 16.

Figure 5:
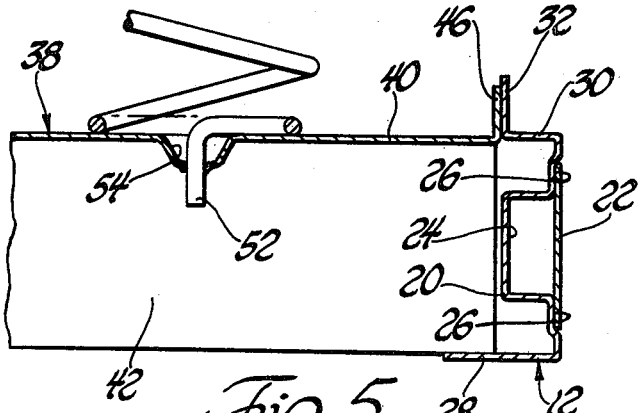
FIG. 5 is an enlarged cross-sectional view taken substantially along line 5—5 of FIG. 2.
Figure 6:
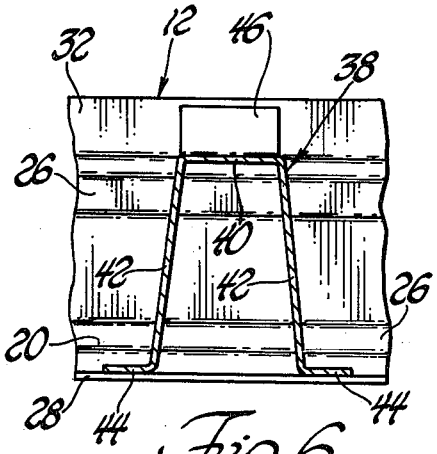
FIG. 6 is an enlarged fragmentary cross-sectional view taken substantially along line 6—6 of FIG. 1.
Figure 7:
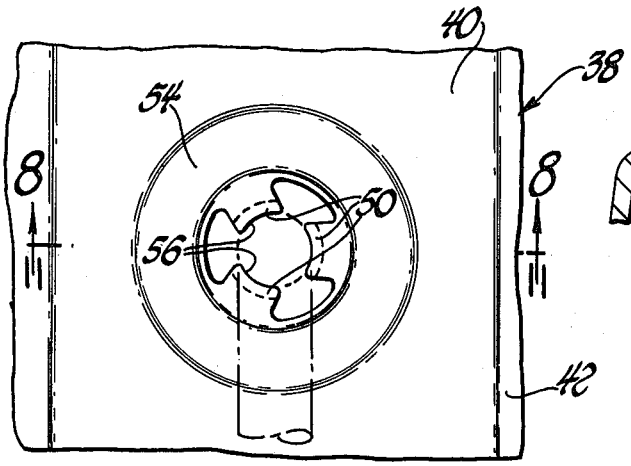
FIG. 7 is an enlarged fragmentary plan view of one of the spring retaining apertures utilized in the assembly of the subject invention.
Figure 8:
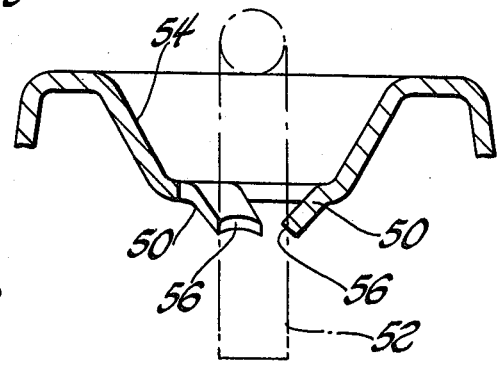
FIG. 8 is an enlarged fragmentary cross-sectional view taken substantially along line 8—8 of FIG. 7.

Each of the side rails 12 includes a pair of metal members defining the hollow cross section. One of the metal members is a channeled member 20 and the other is a closure member 22. The channeled member 20 includes a generally U-shaped channel 24, as shown in FIG. 5, extending longitudinally therealong. The closure member 22 is an elongated plate-like strip extending longitudinally along the channeled member 24 and secured thereto by welding, or the like, adjacent the channel 24 for covering the channel 24 to define the hollow cross section. The channeled member 20 is recessed at 26 along the channel 24 adjacent the top and bottom extremities thereof for receiving the closure member 22 so that the outer surface of the closure member 22 is flush with the outward face of the channeled member 20.

The outward face of the channeled member 20 extends downwardly from the lower extremity of the channel 24 to a slat support flange 28. The slat support flanges 28 are an integral part of the channeled members 20 and extend laterally inwardly toward one another and the middle of the rectangular frame assembly from the sides thereof. The slat support flanges 28 are adjacent to but spaced downwardly from the hollow cross section defined by the channel 24 and the closure member 22. The slat support flanges 28 define the bottom of the side rails 12. The front face of each channeled member 20 extends upwardly from the channel 24 thereof to a top flange 30 which extends inwardly generally parallel to the slat support flanges 28. The top flange is spaced above the channel 24 of the channel member 20. Each side rail 20 also includes a vertical flange 32 extending vertically upwardly from the laterally inwardly disposed edge of the top flange 30.

The channels 24 and the closure members 22 of each of the side rails 12 terminate short of the ends thereof, as best shown in FIG. 2. The ends of the side rails 12 are arcuate, as generally indicated at 34, as viewed in plan and best illustrated in FIG. 1. The ends 34 engage the tops and bottoms of the end of the adjacent end rails 14. The top flange 32 extends through the arcuate end 34 and engages the top of the adjacent end rail 14. Similarly, the slat support flange 28 extends through the arcuate end and engages the bottom of the end of the end rail 14. The corner of the end rail 14 is cut at an angle, as shown in phantom at 36 in FIG. 1.

The assembly also includes a plurality of metal slats, each of which is generally indicated at 38. The metal slats 38 extend transversely between the side rails 12 in spaced parallel relationship to one another and to the end rails 14. Each of the slats 38 has a cross section including a base 40 with downwardly extending diverging legs 42 integral with the base and flanges 44 extending laterally from the lower ends of the respective legs 42. The end portions of the flanges 44 at the ends of the slats 38 are disposed on the slat support flanges 28 of the side rails 12. Each of the slats 38 also include a tab 46 integral therewith and extending upwardly from the base thereof at each end thereof and each of the tabs 46 engages and is secured to the vertical flange 32 of the adjacent side rail 12 by welding, or the like.

There is also included a plurality of spring retaining means disposed in the bases 40 of the slats 38 and in the end rails 14. More specifically, each spring retainer means includes an aperture with tabs 50 extending into the aperture. The tabs 50 extend downwardly at an inclined angle from the periphery of the aperture for engaging the gripping a downwardly extending tail portion 52 of a helical coiled spring. Each aperture is disposed in and surrounded by a concavity or bowl-shaped recess 54 so that each aperture is disposed in the bottom of the concavity 54 whereby the concavity 54 guides the tail 52 of the spring into each of the apertures. There are three tabs 50 extending into each of the apertures from the periphery thereof in a radial direction and each have a circular or arcuate distal end 56 for engaging the tail 52 of a helical coiled spring which has a circular circumference. The coiled springs may be quickly and easily inserted into the apertures and, since the apertures are disposed in a concavity or frusto conical recess 54, the tails 52 of the springs are guided by the recesses 54 into the aperatures to account for tolerances or misalignment in the fabricating equipment.

The components may be efficiently and economically fabricated yet provide an assembly which has very high strength characteristics. The U-shaped members 16 and 18 may be rolled or stamped. The channeled members 20 of the side rails may be stamped while the closure members 22 are raw plate strips. The slats 38 may be rolled and then cut with the tabs 46 formed therein or may be stamped.

Figure 9:
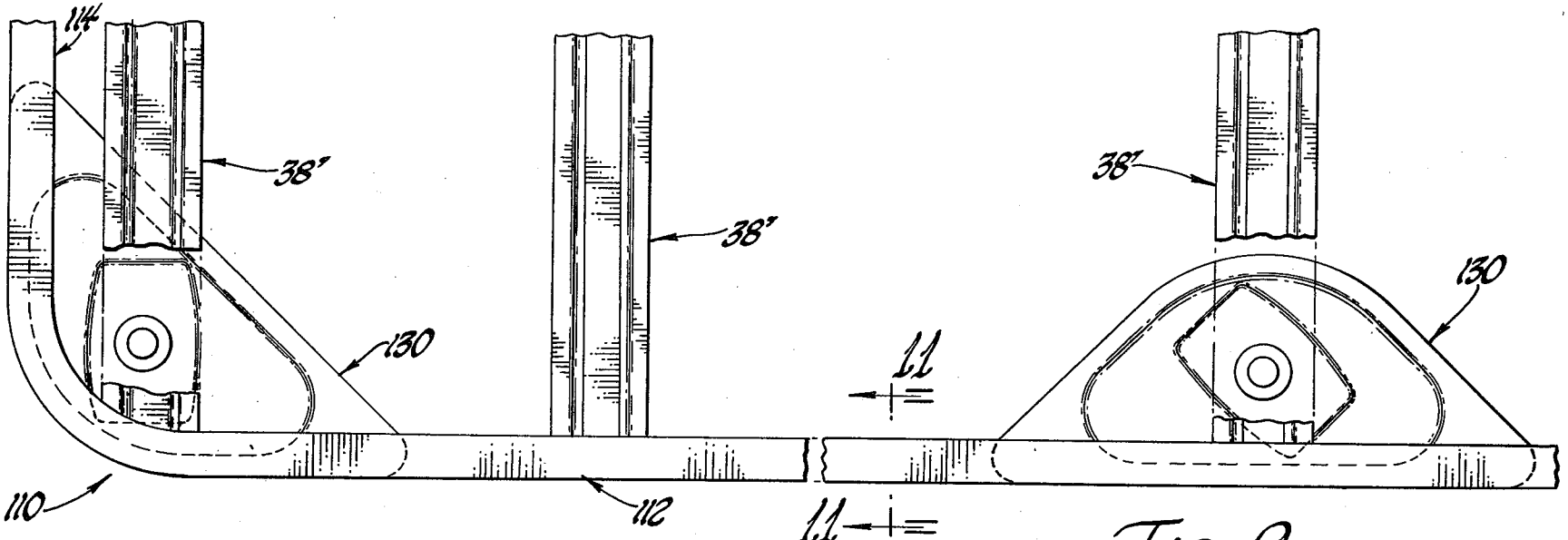
FIG. 9 is a fragmentary plan view showing one corner of a second embodiment of a bed assembly constructed in accordance with the subject invention.
Figure 10:
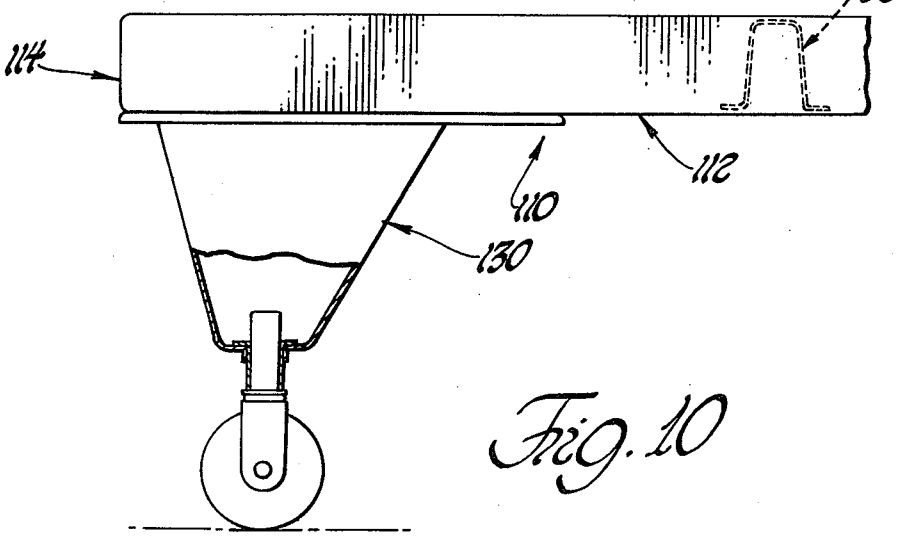
FIG. 10 is a fragmentary side view partially broken away and in cross section of the assembly shown in FIG. 9.

A second embodiment of the bed assembly of the subject invention includes a metal frame means generally shown at 110 in FIGS. 9 and 10. The metal frame means 110 is of a generally rectangular configuration, although only approximately onequarter of the assembly is shown in FIG. 9. The metal frame means includes a pair of opposed side rails, one of which is generally indicated at 112, and a pair of opposed end rails, one of which is generally indicated at 114. The rails 112 and 114 are defined by continuous components or a continuous rail which extends about the corners of the frame assembly with its ends abutting one another and welded together at a position about the periphery of the frame.

Figure 11:
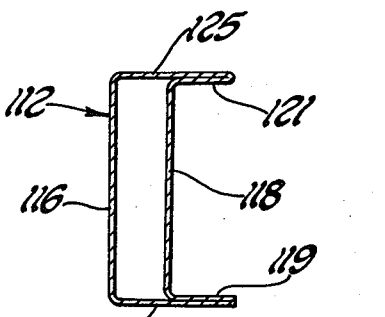
FIG. 11 is a cross-sectional view taken substantially along line 11—11 of FIG. 9.

More specifically, as illustrated in FIG. 11, the cross section of the beams 112 and 114 are alike and include first and second metal members 116 and 118. The first and second members 116 and 118 are each U-shaped in cross section with the second U-shaped member 118 having shorter legs 119 and 121 than the legs 123 and 125 of the first U-shaped member 116. The base portions of the U-shaped members 116 and 118 are spaced apart and are parallel to one another to define the generally rectangular hollow cross section. Like the rail illustrated in FIG. 4, the legs 119, 121, 123 and 125 are parallel to one another and extend in the same direction to define spaced parallel flanges at the vertical extremities of the base portion of the inner member 118. In other words, the legs define flanges which are spaced apart and define an opening for receiving a slat member 38'.

The first leg 123 of the first member 116 is in flat engagement with the first leg 119 of the second member 118. In a similar fashion, the second leg 125 of the first member 116 is in flat engagement with the second leg 121 of the second member 118. The second member 118 is disposed within the first member 116 and the first legs 119 and 123 of the members are welded together as by being spot welded at spaced positions therealong in the same fashion that the legs of the members 16 and 18 shown in FIG. 4 are welded together. In the rail shown in FIG. 4 both sets of legs of the members 16 and 18 are welded together. In the rail shown in FIG. 11 the first and second members are rolled-formed from an integral sheet of metal whereby the second legs 121 and 125 of the members 116 and 118 are integrally connected together. By roll-forming the configuration shown in FIG. 11, there is provided a very efficient and low cost rail member, yet one which provides the requisite strength characteristics and may be used entirely about the periphery of the frame.

As will be appreciated, the ends of the slats 38' may be disposed between the flanges defined by the two sets of legs 119, 121, 123 and 125 with the lower flanges of the slats 38' welded to the legs 119 and 123 and with the top portion of the slats welded to the legs 121 and 125.

The assembly also includes the leg assemblies generally indicated at 130 for attachment to the frame for providing support for the frame assembly. It will be appreciated that the frame assembly is a box spring but one which may be self-supported through the assemblies 130, since the hollow box-like construction of the rail members provide sufficient strength for the frame that additional supporting frames need not be utilized. The assembly of FIGS. 9 through 11 also is of sufficient strength to prevent "racking" from corner to corner.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

The embodiments of the invention in which an exclusive property or privilege is claimed are defined as follows:

1. A bed assembly comprising; metal frame means of generally rectangular configuration including a pair of opposed side rails and a pair of opposed end rails, at least one of said rails including first and second metal members defining a hollow cross section along the length thereof, each of said first and second members being U-shaped in cross section with said second U-shaped member having shorter legs than said first U-shaped member, said legs of said first and second U-shaped members being in engagement with one another and secured together with the base portions of said U-shaped members being spaced apart to define said hollow cross section thereof.

2. An assembly as set forth in claim 1 wherein said base portions are parallel to one another and said legs are parallel to one another with said legs extending in the same direction to define spaced flanges.

3. An assembly as set forth in claim 2 wherein a first leg of said first member is in flat engagement with a first leg of said second member.

4. An assembly as set forth in claim 3 wherein a second leg of said first member is in flat engagement with a second leg of said second member.

5. An assembly as set forth in claim 4 wherein said first legs of said members are welded together.

6. An assembly as set forth in claim 5 wherein said second legs of said members are welded together.

7. An assembly as set forth in claim 5 wherein said second legs of said members are integrally connected together.

8. An assembly as set forth in claim 4 including a pair of said rails and a plurality of metal slats extending transversely therebetween, the ends of said slats being disposed on said first legs of said members, said slats and said first legs all being welded together.

9. An assembly as set forth in claim 8 wherein the tops of said slats engage said second legs of said members and are welded thereto.

10. An assembly as set forth in claim 9 wherein said rails are defined by one continuous rail having its ends secured together about the periphery of said frame means.

11. An assembly as set forth in claim 4 wherein another of said rails includes a metal channeled member and a metal closure member, said channeled member having a generally U-shaped channel extending longitudinally therealong, said closure member extending longitudinally along said channeled member and secured thereto adjacent said channel for covering said channel to define said hollow cross section thereof.

12. An assembly as set forth in claim 11 wherein said channeled member is recessed along said channel for receiving said closure member, said closure member being a flat strip so that said closure member is flush with said channeled member.

13. An assembly as set forth in claim 11 including slat support flanges defined by said channeled members and extending laterally inwardly toward one another from the sides of said frame means.

14. An assembly as set forth in claim 13 wherein said slat support flanges define the bottom of said side rails and each side rail includes a top flange extending inwardly generally parallel to said slat support flanges.

15. An assembly as set forth in claim 14 wherein said slat support flanges and said top flanges are spaced from said adjacent channels.

16. An assembly as set forth in claim 15 wherein each of said side rails includes a vertical flange extending vertically upwardly from said top flange thereof.

17. An assembly as set forth in claim 16 including a plurality of metal slats extending transversely between said side rails in spaced parallel relationship to one another and to said end rails, the ends of said slats being disposed upon said slat support flanges.

18. A bed assembly comprising; metal frame means of generally rectangular configuration including a pair of opposed side rails and a pair of opposed end rails, at least one of said rails including a pair of metal members defining a hollow cross section, one of said members being a channeled member and the other being a closure member, said channeled member having a generally U-shaped channel extending longitudinally therealong, said closure member extending longitudinally along said channeled member and secured thereto adjacent said channel for covering said channel to define said hollow cross section, said channeled member being recessed along said channel for receiving said closure member, said closure member being a flat strip so that said closure member is flush with said channeled member.

19. An assembly as set forth in claim 18 wherein said channeled member is recessed along said channel for receiving said closure member, said closure member being a flat strip so that said closure member is flush with said channeled member.

20. An assembly as set forth in claim 18 including slat support flanges defined by said channeled members and extending laterally inwardly toward one another from the sides of said frame means.

21. An assembly as set forth in claim 20 wherein said slat support flanges define the bottom of said side rails and each side rail includes a top flange extending inwardly generally parallel to said slat support flanges.

* * * * *